United States Patent [19]

Beisswanger

[11] Patent Number: 4,585,253

[45] Date of Patent: Apr. 29, 1986

[54] INDEXING SYSTEM FOR FILE FOLDERS

[75] Inventor: David A. Beisswanger, Bridgewater, N.J.

[73] Assignee: The Shaw-Walker Company, Muskegon, Mich.

[21] Appl. No.: 588,375

[22] Filed: Mar. 12, 1984

[51] Int. Cl.[4] ..... B42F 21/00

[52] U.S. Cl. ..... 283/39; 283/36; 283/37

[58] Field of Search ..... 283/36, 37, 38, 39, 283/40, 41, 43; 40/359, 360

[56] References Cited

U.S. PATENT DOCUMENTS

| | | | |
|---|---|---|---|
| 539,407 | 5/1895 | Bausman | 283/37 |
| 1,275,054 | 8/1918 | Lewis | 283/36 |
| 3,504,907 | 4/1970 | Barber et al. | 283/37 X |
| 3,938,268 | 2/1976 | Gilhula | 283/36 |
| 4,050,719 | 9/1977 | Cunningham | 283/36 |
| 4,182,789 | 1/1980 | Castelluzzo | 283/37 |
| 4,240,848 | 12/1980 | Barber | 283/36 |
| 4,334,771 | 6/1982 | Ryan Jr. | 283/39 |

FOREIGN PATENT DOCUMENTS

| | | | |
|---|---|---|---|
| WO82/01165 | 4/1982 | PCT Int'l Appl. | 283/39 |

*Primary Examiner*—Paul A. Bell
*Assistant Examiner*—Paul M. Heyrana, Sr.
*Attorney, Agent, or Firm*—Kinzer, Plyer, Dorn & McEachran

[57] ABSTRACT

An indexing system for file folders of the type having a tab along one edge includes a pattern of variable length fields formed on the tab. Each field carries indicia of a size proportionate to the field length. The indicia are visible along the edge of a folder placed in storage. When a series of folders are juxtaposed the indicia combine to form a visual pattern which directs a user's eye to the proper location for removing or replacing a particular folder. The indicia comprise color-coded bars which readily create the visual pattern.

12 Claims, 5 Drawing Figures

INDEXING SYSTEM FOR FILE FOLDERS

SUMMARY OF THE INVENTION

This invention relates to an indexing system for file folders.

A primary object of the invention is a file folder indexing system having a coding hierarchy along a tab of the folder.

Another object of the invention is a file indexing system which speeds the filing process.

A further object of the invention is a file indexing system which prevents mis-files.

Another object of the invention is a file indexing system which utilizes color indexing to create a pleasant working environment.

Still another object of the invention is a file indexing system which can use numerical or color-coding or both.

Another object is a file indexing system using colored folders as its base.

Other objects will appear from time to time in the following specification, drawings and claims.

DESCRIPTION OF THE PREFERRED EMBODIMENT

Figure 2:
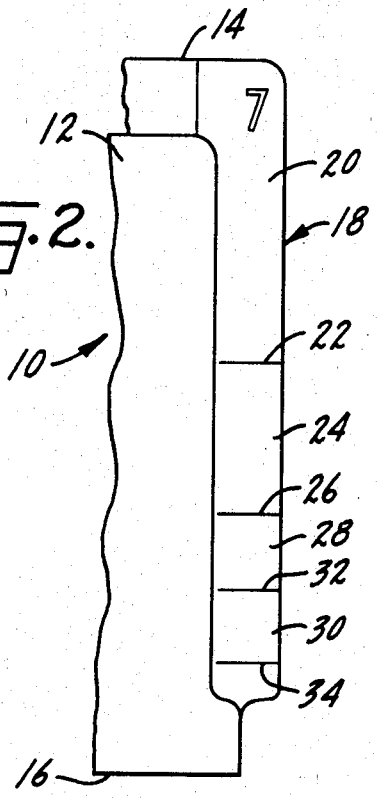
FIG. 2 is a partial, front elevation view of a file folder according to the present invention.
Figure 3:
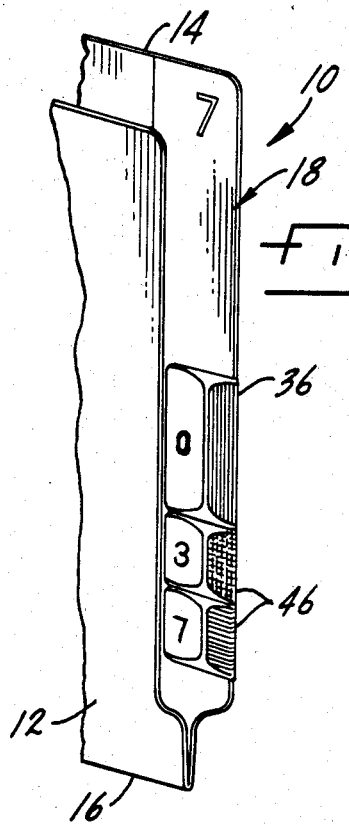
FIG. 3 is a perspective view of the tab portion of a file folder with labels attached to the index fields on the tab.

FIGS. 2 and 3 illustrate a filing folder according to the present invention. The folder 10 has a front panel 12 and a rear panel 14. The two panels are connected along a fold line 16. A portion of one panel extends beyond the other to form a tab 18. In the illustrated embodiment the tab is formed in the rear panel 14 by means of a notch in the front panel and an extension of the rear panel.

The tab is divided into a pattern of different length fields. The fields are areas on the tab on which identification labels will be placed. The field boundaries are indicated by score lines embossed in the tab (FIG. 2). A primary field 20 extends from the top of the tab to score line 22. A secondary field 24 extends from score line 22 to a score line 26. Tertiary fields 28 and 30 are defined by score lines 32 and 34. The primary field 20 is four inches long. The secondary field 24 is two inches long and the tertiary fields 28 and 30 are each one inch long. Thus, it can be seen that the field lengths decrease from one end of the tab to the other. The number and length of the fields could be other than the specific configuration shown.

Each field carries indicia which have a size proportionate to the field size. That is, the relative sizes of the indicia are approximately the same as the relative lengths of their respective fields. The preferred embodiment of the indicia includes a combination of numerical coding and color coding. Each file is designated by a particular numerical code. In the drawings this is shown as a four-digit identification number (FIG. 3), although it could be otherwise according to the user's needs. The identification number then has a corresponding color-code, depending on the digits in its identification number. By way of example only, each digit is assigned a color designation as follows: 0-pink, 1-red, 2-orange, 3-gold, 4-yellow, 5-green, 6-gray, 7-blue, 8-indigo, 9-violet.

Figure 4:
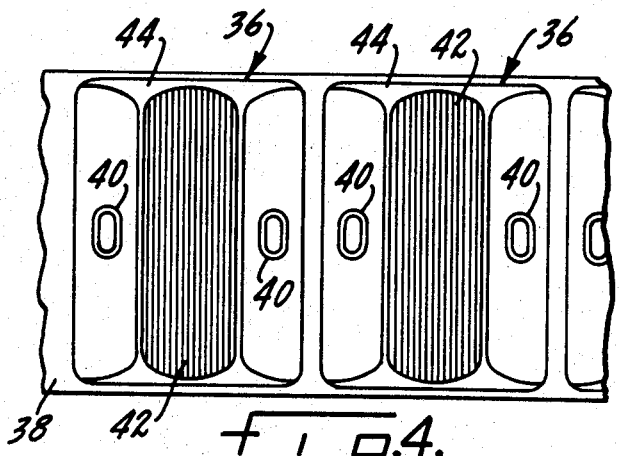
FIG. 4 illustrates a portion of a strip of secondary field labels before application to a folder.
Figure 5:
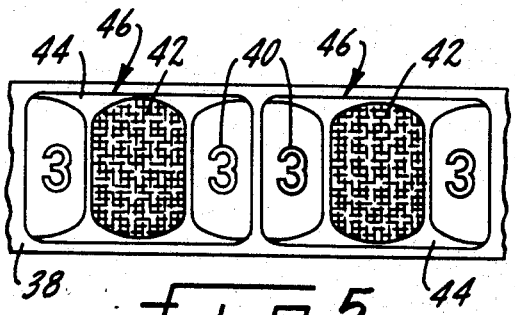
FIG. 5 illustrates tertiary labels on a strip prior to mounting them on a folder.

The indicia for the secondary and tertiary fields are printed on separate labels which are affixed in an appropriate field location. The labels themselves are illustrated in FIGS. 4 and 5. Secondary labels 36 to be used in secondary field 24 are shown in FIG. 4. The labels have a pressure sensitive adhesive on one side and are initially mounted on a release liner 38. The indicia on the label include reference numerals or digits 40, in this case a "0". In the center of the label 36 is a color bar 42 corresponding to the reference digit "0". In this case the color bar would be pink and the drawing is lined for the color pink. The color bar 42 is surrounded by a border 44. The border is a contrasting color such as black which will assist in differentiating adjacent color bars when the labels are placed on a tab. The reference numerals 40 are preferably placed on a light colored background. Tertiary labels 46 for use in tertiary field 28 or 30 are shown in FIG. 5. The indicia on the tertiary labels are the same as on the secondary labels only in a smaller size. Also, the color bar 42 in FIG. 5 is lined for the color gold, which corresponds to the reference digit 3.

FIG. 3 illustrates the application of the labels to a folder. In the example shown, the folder has the identification number "7037". The first digit of this identification number is given greatest prominence on the tab 18 of the folder 10. This is done by pre-printing the indicia in the primary field 20. The indicia includes the large reference number "7" and the color blue. The entire folder is colored blue so the front and rear panels 12 and 14 as well as the primary field 20 will have the color blue.

The second digit in the identification number is a "0" so in preparing the file a user would remove a secondary label 36 having the digit "0" and the pink color bar from a release liner 38. Using the score marks 22 and 26 for a locating reference, the user would apply the secondary label to the secondary field 24 of the tab. The label is folded around the edge of the tab so that approximately half of the label is on each side of the tab. Thus, the center of the color bar is on the edge of the tab. The edge of the tab would then have a four inch blue color bar and an approximately two inch pink color bar.

The third digit of the identification number is indicated on the tab by applying a tertiary label 46. The user would apply the label having the digit "3" and the gold color bar. Likewise, the fourth digit is indicated on the tab by another tertiary label having the digit "7" and the blue color bar. Thus, the edge of the tab for file number 7037 will have a four inch blue color bar, an approximately two inch pink color bar, an approximately one inch gold color bar and finally, an approximately one inch blue color bar.

Figure 1:
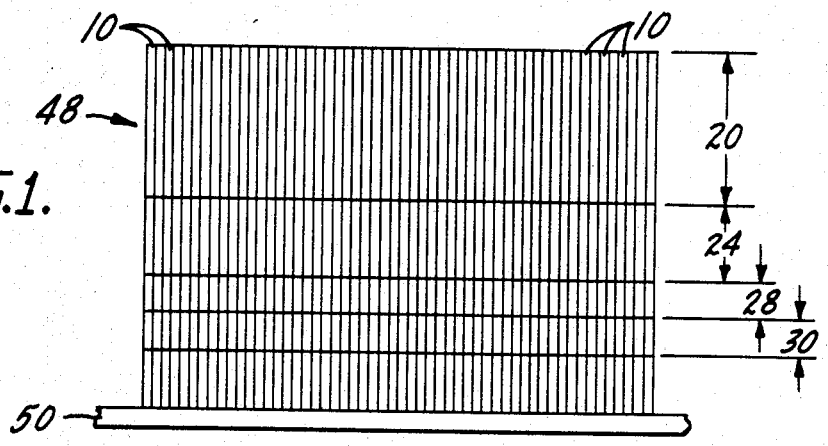
FIG. 1 is a schematic, end elevation view of the edges of a plurality of file folders, resting on a shelf.

FIG. 1 illustrates the effect created by the described indexing system 48 when a plurality of folders 10 are juxtaposed on a shelf 50. With the edges of the tabs exposed the folders form bands of color indicated by the primary field 20, the secondary field 24 and the tertiary fields 28 and 30. When properly labeled folders are placed in numerical sequence, these color bands quickly indicate where a folder is located or where a folder should be returned. In the example shown it will be apparent that one thousand consecutive folders will have an identical primary field color. Also, one hundred consecutive folders will display the same color in the secondary field while ten straight folders will have the same color in the first tertiary field. Mis-filed folders are readily apparent because one of the color bands on a mis-filed folder will not match its neighbors. This inconsistency in the color pattern is readily apparent even upon only a quick glance at the storage shelf.

In a preferred embodiment the file folders are eleven point and will have reinforced side tabs. The labels are printed with acrylic based ink on sixty pound paper stock with a two mil, matte finish polylaminate.

One of the important features of the present invention is the variable lengths of the fields. In the preferred form, these lengths decrease from one end of the tab to the other. This creates a "funnel principle " for color indexing. Primary visual emphasis is given to the first digit of an identification number by means of the four inch primary field. Subsequent identification digits are given progressively less importance. The color pattern created by this concept leads the eye rapidly and unerringly to the correct folder. Color patterns other than the "funnel principle " could be used so long as variable field lengths are employed to create a definite scheme which directs a user to a particular file location.

I claim:

1. An indexing system for file folders of the type having a front panel and a rear panel, the panels being connected along a fold line and a portion of one panel extending beyond the other to form a tab, the indexing system comprising a pattern of different length fields on the tab, each field carrying indicia, the indicia having a size substantially equal to the field length and being visible on a folder placed in storage such that when a series of folders are juxtaposed the variable lengths of the indicia combine to create a visual pattern which directs a user's eye to the proper position of an individual folder.

2. The indexing system of claim 1 wherein the field lengths decrease from one end of the tab to the other.

3. The indexing system of claim 1 wherein the field pattern comprises at least one primary field at one end of the tab, at least one secondary field adjacent to the primary field and having a shorter length than the primary field and at least one tertiary field adjacent to the secondary field and having a shorter length than the secondary field.

4. The indexing system of claim 3 wherein the primary field is about twice as long as the secondary field.

5. The indexing system of claim 3 wherein the secondary field is about twice as long as the tertiary field.

6. The indexing system of claim 4 wherein the secondary field is about twice as long as the tertiary field.

7. The indexing system of claim 1 wherein the field locations are designated by score marks on the tab.

8. The indexing system of claim 1 wherein the indicia of at least one field is pre-printed on the folder.

9. The indexing system of claim 1 wherein the indicia of at least one field is printed on a label which is affixed to the tab at the appropriate field location.

10. The indexing system of claim 1 wherein the indicia include numerals.

11. The indexing system of claim 1 wherein the indicia include color-coding.

12. The indexing system of claim 10 wherein the indicia include color-coding.

* * * * *